US006799625B2

(12) United States Patent
Eliat

(10) Patent No.: US 6,799,625 B2
(45) Date of Patent: Oct. 5, 2004

(54) SEALING ARRANGEMENT FOR A MOVABLE INSERT FOR A DIE CASTING MOLD HAVING A RETRACTABLE CORE

(75) Inventor: Constantin Eliat, Hamilton (CA)

(73) Assignee: Amcan Consolidated Technologies Corp., Hamilton (CA)

( * ) Notice: Subject to any disclaimer, the term of this patent is extended or adjusted under 35 U.S.C. 154(b) by 0 days.

(21) Appl. No.: 10/303,828

(22) Filed: Nov. 26, 2002

(65) Prior Publication Data

US 2003/0192666 A1 Oct. 16, 2003

(30) Foreign Application Priority Data

Apr. 10, 2002 (CA) ..... 2381210
May 28, 2002 (BR) ..... 0201965

(51) Int. Cl.[7] ..... B22D 17/24; B22D 33/04
(52) U.S. Cl. ..... 164/340; 164/342
(58) Field of Search ..... 164/137, 340, 164/342, 369

(56) References Cited

U.S. PATENT DOCUMENTS 617,396 A 1/1899 Hay ..... 249/64
1,730,469 A * 10/1929 Millspaugh ..... 164/340
3,433,292 A 3/1969 McDonald ..... 164/343
3,442,323 A 5/1969 Lewis ..... 164/332
3,849,053 A 11/1974 Bruce et al. ..... 425/438
4,611,650 A * 9/1986 Fort et al. ..... 164/298
4,919,189 A 4/1990 Sato et al. ..... 164/137
5,137,076 A * 8/1992 Takahashi ..... 164/320
5,843,494 A * 12/1998 Richardson ..... 425/468
5,862,853 A * 1/1999 Eliat ..... 164/340

FOREIGN PATENT DOCUMENTS

JP 58192652 11/1983 ..... B22C/9/10

* cited by examiner

*Primary Examiner*—Kiley Stoner
*Assistant Examiner*—Kevin P. Kerns
(74) *Attorney, Agent, or Firm*—Gowling Lafleur Henderson LLP; Peter Milne

(57) ABSTRACT

A movable insert for a die-casting mold. The movable insert has a parallel-sided cavity which slidably receives a retractable core. The retractable core is movable between a retracted position within the movable insert to an extended position extending from the movable insert. The retractable core has a connector for its releasable securement to a locator which moves it between the extended and retracted positions. The retractable core is further provided with a sealing member extending thereabout and between it and the sides of the cavity walls. The sealing member provides a slidable seal between the retractable core and the sides of the cavity.

10 Claims, 4 Drawing Sheets

SEALING ARRANGEMENT FOR A MOVABLE INSERT FOR A DIE CASTING MOLD HAVING A RETRACTABLE CORE

FIELD OF THE INVENTION

This invention relates to movable inserts for a die-casting mold and more particularly to such inserts which incorporate a movable core and still more particularly to sealing between the movable insert and the retractable core.

BACKGROUND OF THE INVENTION

An earlier invention, as described in U.S. Pat. No. 5,862,853 which issued on Jan. 26, 1999, comprises a movable insert for a die-casting mold having a cavity in which a core is mounted and slidable between a retracted position in the cavity and an extended position in which the core extends from the movable insert.

FIG. 1 is a sectional view through a prior art die-casting mold assembly, generally indicated by reference 10 for casting a part 12 having an opening or boss 14 extending therethrough which is non-parallel to a "machine direction" indicated by arrows 16. The opening 14 is narrower at a point 17 part way along its length than it is toward either end.

The mold assembly 10 includes a movable insert 18, a fixed insert 20 and a slide 22. The mold assembly 10 is generally opened and closed in the machine direction. The slide 22, as indicated by arrows 24, is inserted and removed from the balance of the mold assembly 10 in a direction non-parallel to the machine direction.

The slide 22, in combination with a retractable core 26 is used to form an interior surface which defines the opening 14. The retractable core 26 forms the portion of the interior surface of the opening 14 between the movable insert 18 and the point 17. The slide 22 forms the remainder of interior surface of the opening 14.

As the part 12 is stripped in the machine direction, obviously it is necessary to separate and withdraw the retractable core 26 and the slide 22 from the opening 14 to enable the part to be separated from the movable insert. The slide 22 is withdrawn to the right as illustrated in the direction of arrows 24. The retractable core 26, as its name suggests, is retracted into a cavity 28 in the movable insert. Movement of the retractable core 26 is controlled by a locator 52.

FIGS. 2 and 3 are sectional views illustrating the relationship between the movable insert 18 and the retractable core 26 in more detail. In FIG. 2 the retractable core is illustrated in a retracted position in which it doesn't protrude from the movable insert 18. In FIG. 3 the retractable core is illustrated in an extended position in which it extends from the movable insert 18. The extended position corresponds to the molding of the part 12. The retracted position corresponds to the stripping of the part 12.

It is of course necessary to prevent molten metal from seeping past the retractable core 26 into the cavity 28 to prevent the retractable core 26 from becoming "stoned" in metal (i.e., frozen in place). In the prior art arrangement, as best illustrated in FIGS. 2 and 3, sealing was accomplished by the mating of corresponding tapered surfaces 30 and 32 respectively on the retractable core 26 and the movable insert 18. This arrangement however has some drawbacks. Very accurate machining is required to match the tapered surfaces 30 and 32 to give an effective seal relative to each other. Furthermore the tapered surfaces 30 and 32 must be accurately situated for the surfaces 30 and 32 to abut when the retractable core 26 is in its extended position. Any inaccuracies in the situation of the tapered surfaces 30 and 32 will either leave a gap therebetween or prevent the retractable core from fully extending. A relatively small degree of wear on the tapered surfaces 30 and 32 resulting from repeated retraction and extension of the retractable core 26 will eventually cause the seal between the tapered surfaces 30 and 32 to lose effectiveness. Once this occurs there is no simple way to restore the sealing surfaces as lapping or grinding will give a resultant seal which is only effective at a greater degree of extension of the retractable core 26. Further extending the retractable core 26 is undesirable as it affects the location of the portion of the inner surface of the opening 14 which is to be formed thereby. Finally, there is no "wiping" action upon extension and retraction to prevent any solid particles from coming between and interfering with the seal between the tapered surfaces 30 and 32.

It is therefore an object of the present invention to provide a sealing arrangement between a retractable core and a movable insert which is not position sensitive, which is tolerant of wear between the retractable core and the movable insert, which is relatively simple to refurbish and which is tolerant of the presence of dirt or other solid particles.

SUMMARY OF THE INVENTION

A movable insert for a die-casting mold, the movable insert having a cavity with substantially parallel sides extending thereabout and a core slidably mounted in the cavity. The core is slidably movable between an extended position in which it extends beyond the movable insert and a retracted position in which it does not extend from the movable insert. The core has a connector for releasable attachment to a locator which moves the core between its retracted and its extended positions. A sealing member extends about the core, between the core and the sides of the cavity wall to provide a slidable seal between the core and the sides.

The sealing member may be a resilient metal ring which may be received in a groove extending about the core. The sealing member may be annular and of cast iron or stainless steel.

DESCRIPTION OF DRAWINGS

Preferred embodiments of the present invention are described below with reference to the accompanying drawings in which.

DESCRIPTION OF PREFERRED EMBODIMENT

Figure 2:
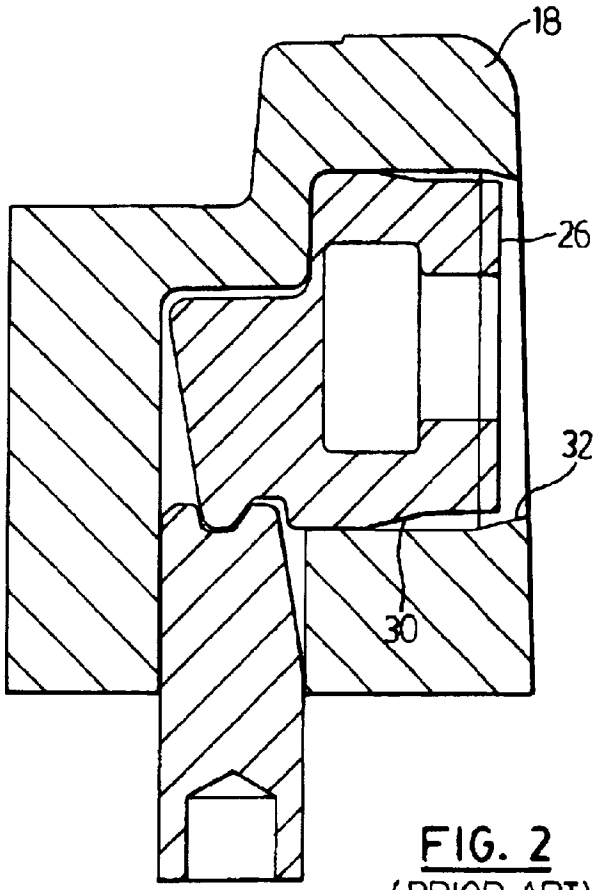
FIG. 2 (PRIOR ART)
FIG. 2 is a sectional view through a prior art movable insert having a retractable core which is illustrated in a retracted position.
Figure 1:
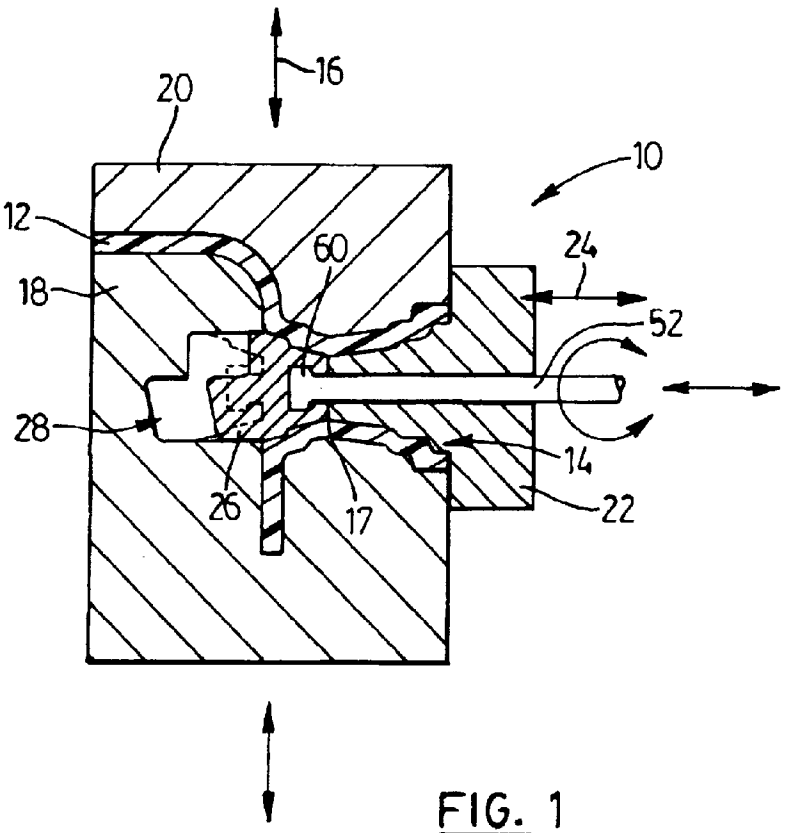
FIG. 1 (PRIOR ART)
FIG. 1 is a sectional view through a prior art die-casting mold assembly.
Figure 4:
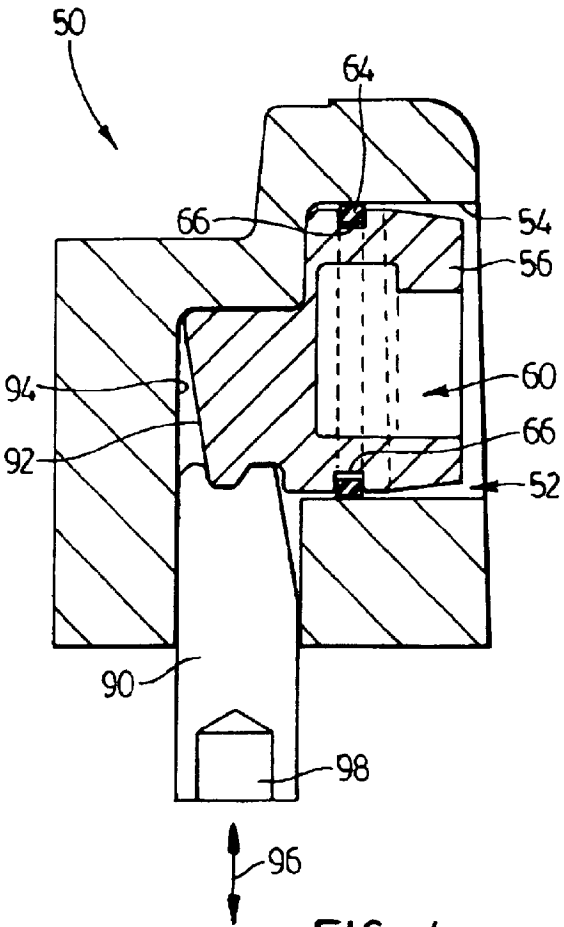
FIG. 4 is a sectional view through a movable insert according to the present invention, showing a retractable core in its retracted position.
Figure 3:
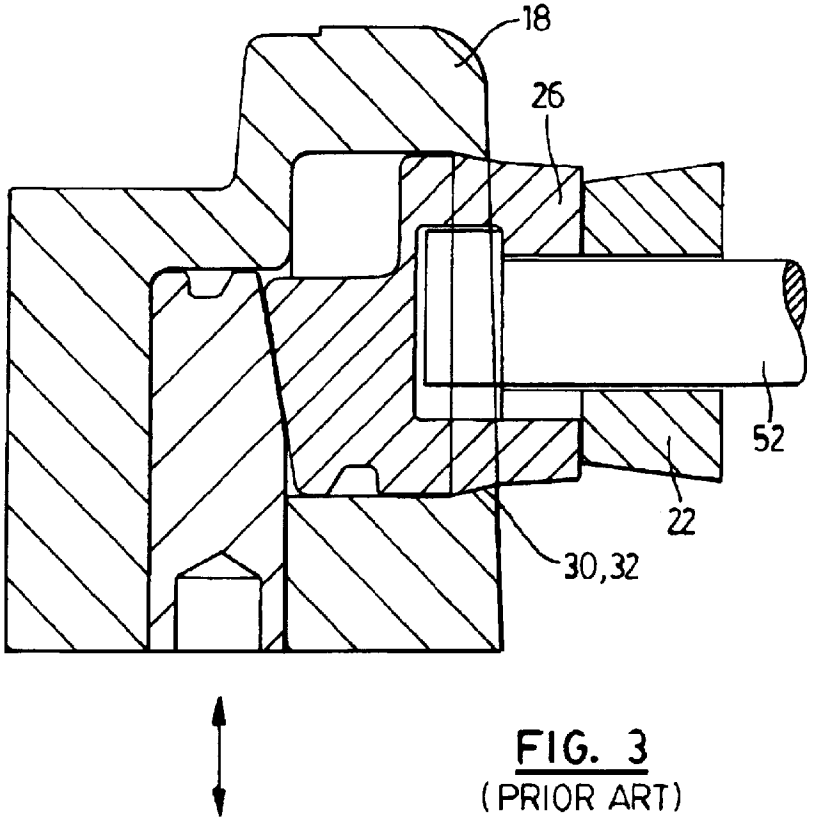
FIG. 3 (PRIOR ART)
FIG. 3 is a sectional view corresponding to FIG. 2 but showing the retractable core in an extended position.
Figure 5:
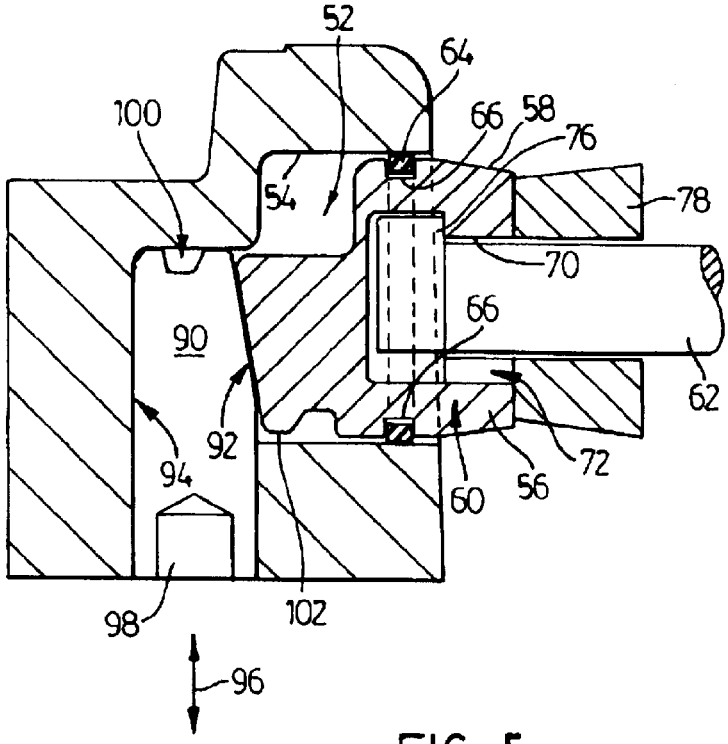
FIG. 5 is a sectional view corresponding to FIG. 4 but showing the retractable core in an extended position.

A movable insert for a die-casting mold according to the present invention is generally indicated by reference 50 in FIGS. 4 and 5. The movable insert 50 includes a cavity 52 having substantially parallel sides. In most cases the cavity sides 54 will be cylindrically disposed however this is not an absolute requirement.

A retractable core 56 is slidably mounted in the cavity 52 for movement between a retracted position, as illustrated in FIG. 4, and an extended position, as illustrated in FIG. 5. In the retracted position, the retractable core 56 is substantially housed within the movable insert 50 and does not extend therefrom. In the extended position the retractable core 56 extends from the movable insert 50 to present a mold face 58.

A connector 60, described in more detail below, is provided on the retractable core 56 for releasably connecting the retractable core 56 to a locator 62 which moves the retractable core 56 between its extended and its retracted positions.

A sealing member 64 extends about the retractable core 56 and extends between the retractable core 56 and the cavity sides 54. The sealing member 64 may be a resilient metal ring received in a groove 66 extending about the retractable core 56. The sealing member 66 is preferably of stainless steel or cast iron, such as used for piston rings of internal combustion engines. Most preferably the sealing member is of cast iron which appears to have better temperature stability than stainless steel. The sealing member 64 will typically have a gap 65 along its circumference to allow it to be expanded for mounting over the retractable core 56. The breadth of the gap should be selected so as to be substantially closed at operating temperatures to prevent metal seepage therethrough.

An advantage of the arrangement of the present invention is that the resiliently expansive nature of the sealing member 64 allows it to maintain a closer spacing with the walls 54 of the cavity 52 than between the walls 54 of the cavity and the retractable core 56. Furthermore, the resiliently expansive nature of the sealing member 64 enables it to accommodate wear along the cavity walls 54.

As the walls 54 of the cavity 52 are substantially parallel and lack the tapered surfaces 30 and 32 of the prior art, it will be apparent that lateral positioning of the retractable core 56 does not determine the effectiveness of the seal between the retractable core 56 and the cavity 52. Accordingly, unlike the earlier arrangement, the present arrangement allows the stroke of the retractable core 56 to be adjusted to adjust part accuracy.

Should the parts of the movable insert 50 become overly worn, refurbishment is a relatively simple matter and includes various options such as: boring and sleeving the cavity 52; honing the cavity 52 and fitting an oversize sealing member 64; and, boring the cavity 52 and fitting suitably dimensioned retractable core 56 and sealing member 64.

Figure 6:
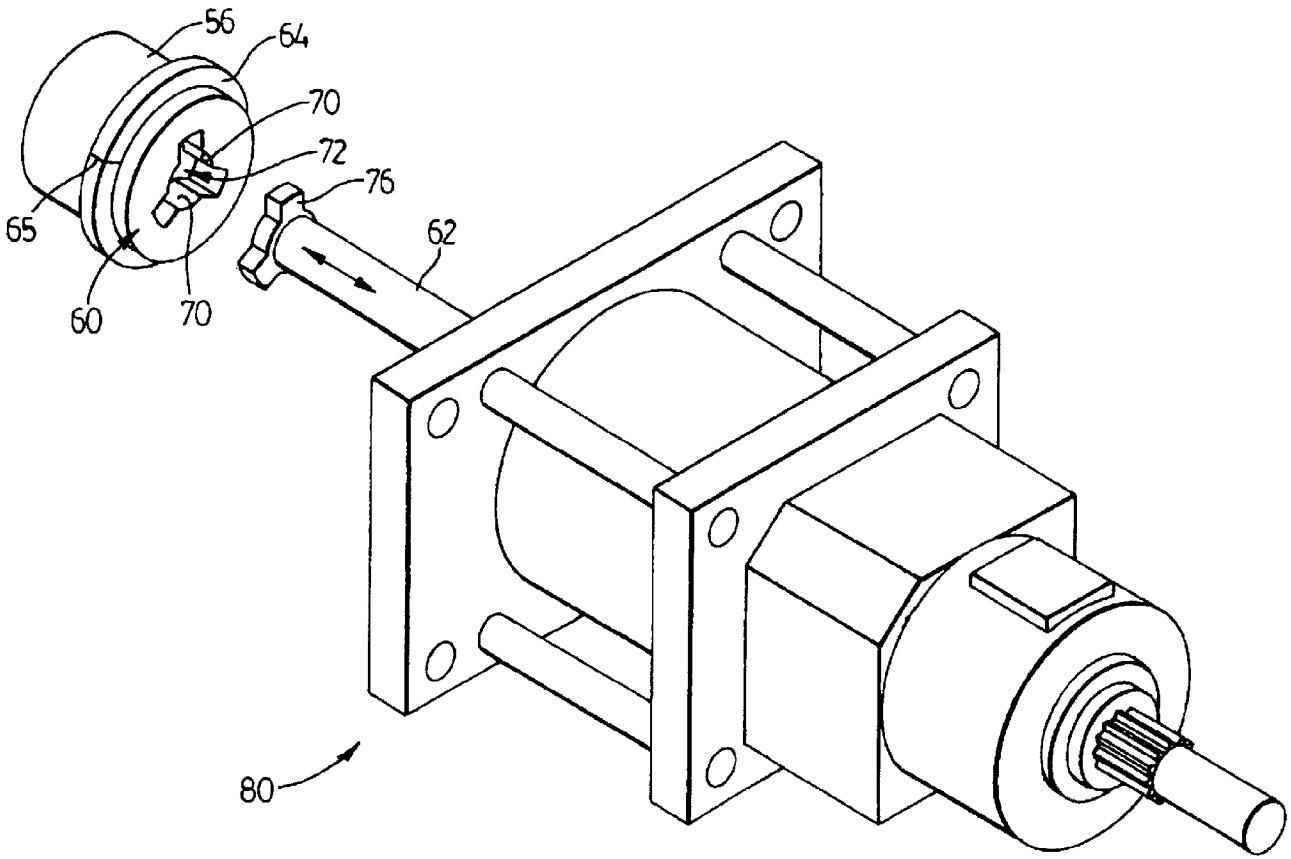
FIG. 6 is an isometric view illustrating a retractable core according to the present invention and a locator.

As in the previous arrangement, the retractable core is moved between its 15 retracted and extended positions by a locator 62. The interrelationship between the locator 62 and the retractable core 56 is best seen in FIG. 6. The locator 62 is coupled and uncoupled from the retractable core 56 by a connector comprising radially inwardly extending projections 70 surrounding a recess 72 extending into the retractable core and corresponding radially outwardly extending projections 76 on an end of the locator 62. The connector 60 is movable between engaged and disengaged positions. In the disengaged position, which is shown in FIG. 6, the outwardly extending projections 76 on the locator 62 and the inwardly extending projections 70 on the retractable core 56 are misaligned so that the locator 62 may be inserted into or removed from the recess 72 in the retractable core 56. In the engaged position, which is shown in FIG. 5, the outwardly extending projections 76 are aligned with the inwardly extending projections 70 as to register therewith and enable the locator 62 to withdraw the retractable core 56 from the cavity 52 into its extended position.

Movement of the locator 62 may be controlled by a positioning device such as described in U.S. Pat. No. 5,862,853 referred to above or the improved device in U.S. Pat. No. 5,843,494. The latter is generally depicted by reference 80 in FIG. 6.

Preferably means should be provided to lock the retractable core 56 in its extended and retracted positions. Failure to lock the retractable core 56 in its extended position may result in the pressure of the molten metal being injected tending to move the retractable core 56 into the cavity 52. Failure to lock the retractable core 56 in its retracted position may result in the retractable core 56 being at least partially sucked into its extended position by removal of a slide 78 adjacent thereto.

As illustrated in FIG. 5, a wedge shaped abutment member 90 may be slidably inserted between a rear face 92 of the retractable core 56 and a rear wall 94 of the cavity 52. Slidable movement of the abutment 90 in a direction shown by arrows 96 may be effected by a hydraulic cylinder (not shown) having a rod 98 connected to the abutment member 90.

As illustrated in FIGS. 4 and 5, to prevent movement of the retractable core 56 out of its retracted position, a core lock may be provided which includes a first component in the form of a recess 100 in an end of the abutment member 90 which registers and may be pressed into engagement with a corresponding projection 102 formed in the retractable core 56 adjacent its rear face 92. Movement of the projection 102 into the recess 100 may be effected by action of the rod 98. It will be appreciated that this is but one possible configuration for the core lock. For example, a projection may be provided on the abutment 90 which registers with a corresponding recess in the retractable core 56. Alternatively both projection recesses may be provided on each component.

The above description is intended in an illustrative rather than a restrictive sense. Variations may be apparent to persons skilled in such apparatus without departing from the spirit and scope of the invention as defined by the claims set out below.

I claim:

1. A movable insert for a die-casting mold, said movable insert comprising:

a cavity having substantially parallel sides extending thereabout;

a retractable core slidably mounted in said cavity for movement between a retracted position in which said retractable core does not extend beyond said movable insert and an extended position in which said retractable core extends from said movable insert;

said retractable core having a connector for releasably connecting said retractable core to a locator for movement of said retractable core between said retractable and extended positions; and, a sealing member extending about said retractable core and extending between said retractable core and said cavity sides for providing a slidable seal between said retractable core and said sides.

2. A movable insert as claimed in claim 1 wherein:

said retractable core is movable in a direction non-parallel to a machine direction to form a recess in a molded article extruding away from said movable insert in said non-parallel direction.

3. A movable insert according to claim 2 wherein:

said sealing member is a resilient metal ring.

4. A movable insert according to claim 3 wherein:

said retractable core has a groove extending thereabout for receiving said metal ring and said ring has a gap in its circumference enabling it to be expanded over said retractable core for mounting in said groove.

5. A movable insert according to claim 4 wherein:

said cavity wall is substantially cylindrical;

said metal ring is annular; and, said metal ring is of a material selected from the group consisting of cast iron and stainless steel.

6. A movable insert according to claim 5 wherein:

said connector includes radially inwardly extending projections which register with corresponding radially outwardly extending projections on said locator.

7. A movable insert according to claim 6 further including an abutment member insertable between a rear face of said retractable core and a rear wall of said cavity when said retractable core is in said extended position to prevent movement of said retractable core into said cavity.

8. A movable insert according to claim 7 further including a retractable core lock for locking said retractable core in said retracted position.

9. A movable insert according to claim 8 wherein:

said retractable core lock includes one of a projection and a recess on said abutment which registers with the other of a projection and a recess on said retractable core.

10. A movable insert as claimed in claim 9 wherein:

said retractable core lock includes a recess at an inner end of said abutment which receives a ridge adjacent said rear face of said retractable core.

* * * * *